US007442057B2

(12) United States Patent
Ko

(10) Patent No.: US 7,442,057 B2
(45) Date of Patent: Oct. 28, 2008

(54) MIMO RF CONNECTOR ASSEMBLY

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/580,608

(22) Filed: Oct. 12, 2006

(65) Prior Publication Data

US 2008/0090430 A1 Apr. 17, 2008

(51) Int. Cl.
*H01R 4/66* (2006.01)

(52) U.S. Cl. ..... 439/101

(58) Field of Classification Search ..... 439/101, 439/610, 447, 686, 108, 608, 79, 502, 626, 439/680, 607, 541.5, 695, 697
See application file for complete search history.

(56) References Cited

U.S. PATENT DOCUMENTS 6,280,209 B1 * 8/2001 Bassler et al. ..... 439/101
6,508,671 B2 * 1/2003 Ko ..... 439/610
6,863,549 B2 * 3/2005 Brunker et al. ..... 439/108

* cited by examiner

*Primary Examiner*—Edwin A. León
(74) *Attorney, Agent, or Firm*—Wei Te Chung

(57) ABSTRACT

A connector assembly includes a receptacle connector and a plug connector. The receptacle connector includes a first housing including a base plate and a tongue portion including a pair of first and second halves, and a number of first contacts protruding through the base plate and received in the first and second halves of the first housing. The plug connector includes a second housing, a plurality of second contacts received in the second housing, and a cable electrically connecting with the second contacts. The second housing includes a pair of sidewalls, an upper wall connecting with upper ends of the sidewalls, and an insert section connecting with the sidewalls to form a first space together with the upper wall and the sidewalls, and a second space together with the sidewalls. The first half of the tongue portion of the first housing of the receptacle connector is received in the first space of the second housing, and the second half of the tongue portion is received in the second space of the second housing, and the insert section of the second housing of the plug connector is received between the first and second halves of the tongue portion and the first and second contacts electrically connect with one another.

15 Claims, 11 Drawing Sheets

MIMO RF CONNECTOR ASSEMBLY

BACKGROUND OF THE INVENTION

1. Field of the Invention

The present invention generally relates to a connector assembly, and more particularly to an MIMO RF connector assembly.

2. Description of Related Art

RF connector assemblies usually comprise plug connectors and receptacle connectors and are widely used to transmit signals received by antennas to mother boards on which the receptacle connectors are mounted. The RF plug connector usually comprises a single coaxial cable transmitting a single signal for the system in which the RF connector assemblies are arranged. However, with the development of electronics, multiple signal transmission is highly desired currently. To meet the demand mentioned above, an MIMO RF connector assembly is provided in the present invention to address the problems mentioned above and meet the current trend.

BRIEF SUMMARY OF THE INVENTION

Accordingly, an object of the present invention is to provide a connector assembly for MIMO transmission and with low cost.

Another object of the present invention is to provide a plug connector with new profile.

In order to achieve the above-mentioned object, a connector assembly in accordance with the present invention comprises a receptacle connector and a plug connector. The receptacle connector comprises a first housing comprising a base plate and a tongue portion comprising a pair of first and second halves, and a plurality of first contacts protruding through the base plate and received in the first and second halves of the first housing. The plug connector comprises a second housing, a plurality of second contacts received in the second housing, and a cable electrically connecting with the second contacts. The second housing comprises a pair of sidewalls, an upper wall connecting with upper ends of the sidewalls, and an insert section connecting with the sidewalls to form a first space together with the upper wall and the sidewalls, and a second space together with the sidewalls. The first half of the tongue portion of the first housing of the receptacle connector is received in the first space of the second housing, and the second half of the tongue portion is received in the second space of the second housing, and the insert section of the second housing of the plug connector is received between the first and second halves of the tongue portion and the first and second contacts electrically connect with one another.

Other objects, advantages and novel features of the invention will become more apparent from the following detailed description of the present embodiment when taken in conjunction with the accompanying drawings.

DETAILED DESCRIPTION OF THE INVENTION

Figure 1:
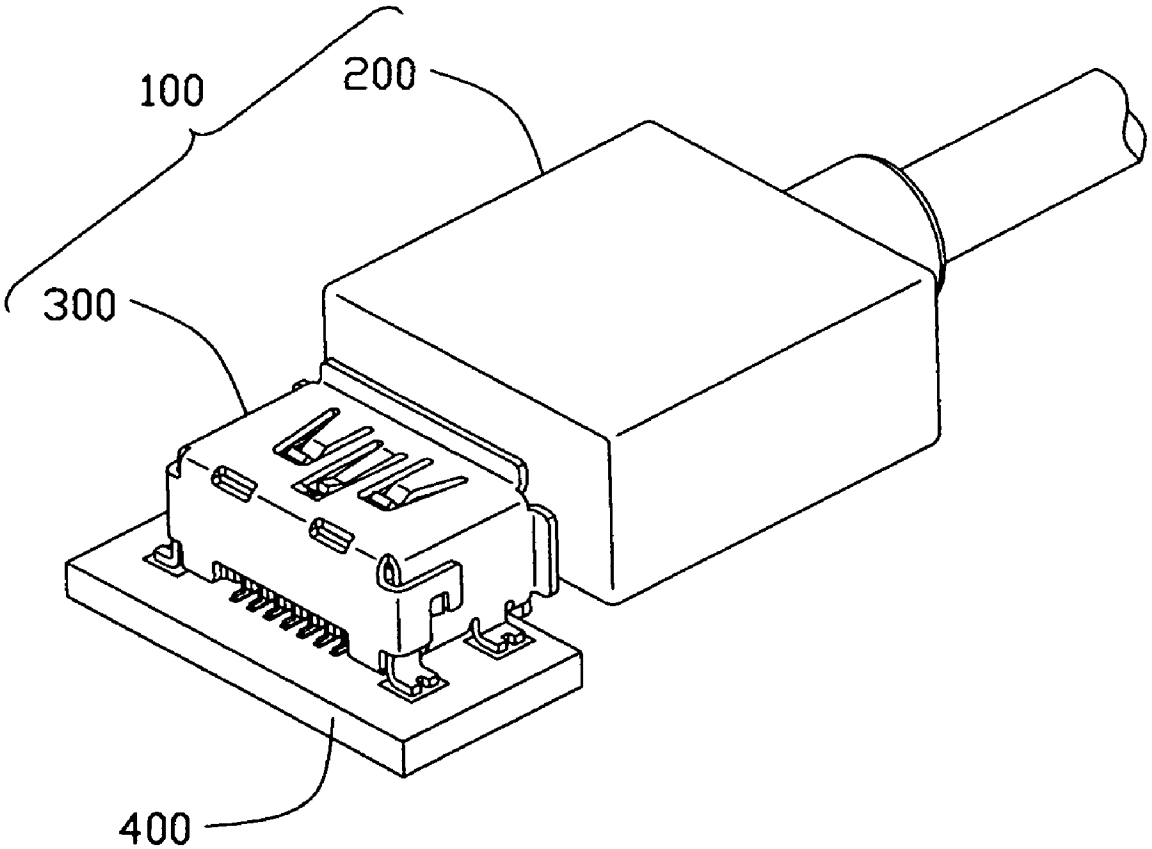
FIG. 1 is an assembled, perspective view of a connector assembly in accordance with the present invention.
Figure 2:
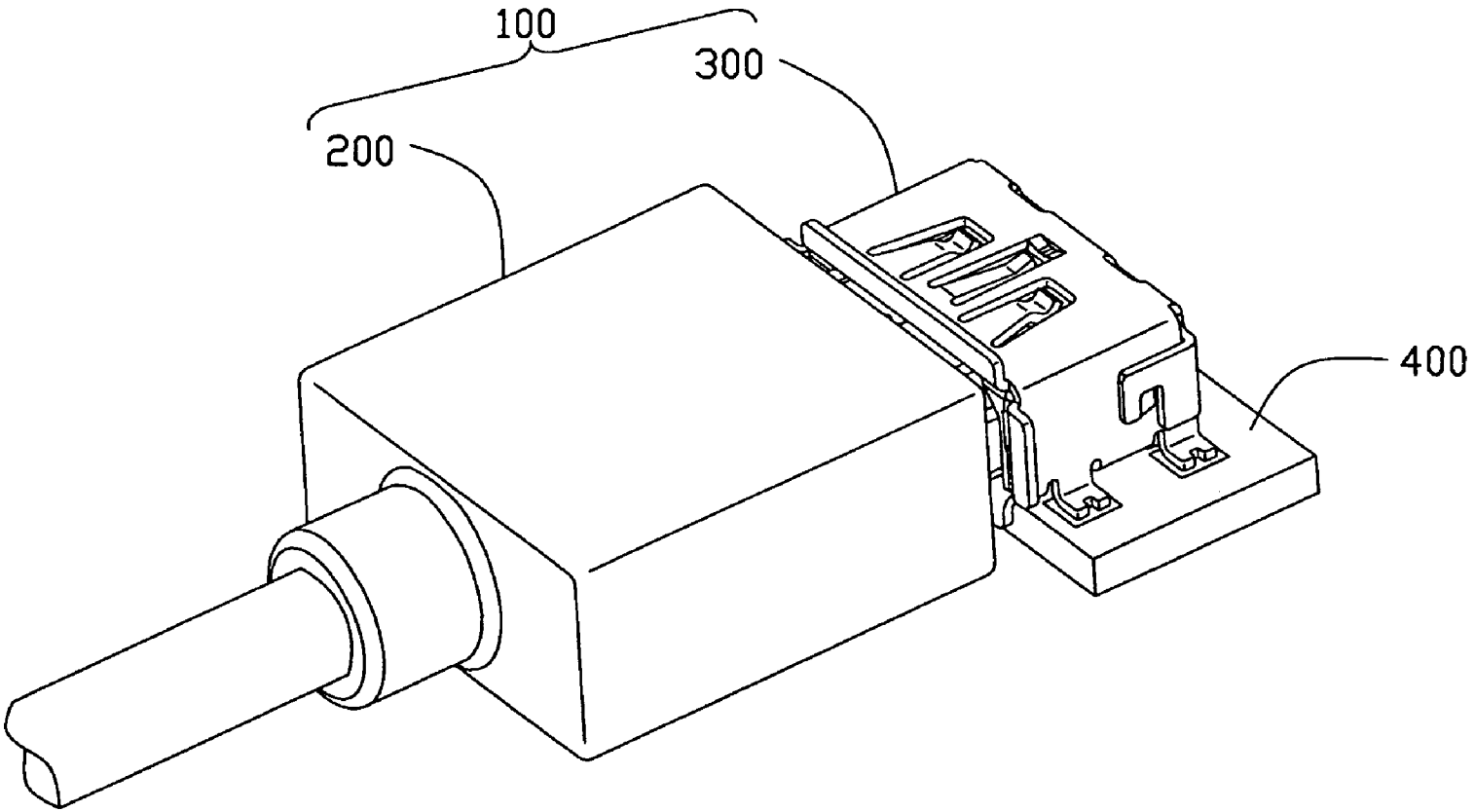
FIG. 2 is similar to FIG. 1, but viewed from a different aspect.

Reference will now be made to the drawing figures to describe the present invention in detail.

Referring to FIGS. 1-4, a connector assembly 100 in accordance with the present invention comprises a plug connector 200 and a receptacle connector 300 matable with the plug connector 200. The receptacle connector 300 is surface mounted on a circuit board 400. The connector assembly 100 is used to transmit signals received by an antenna to the circuit board 400.

Figure 3:
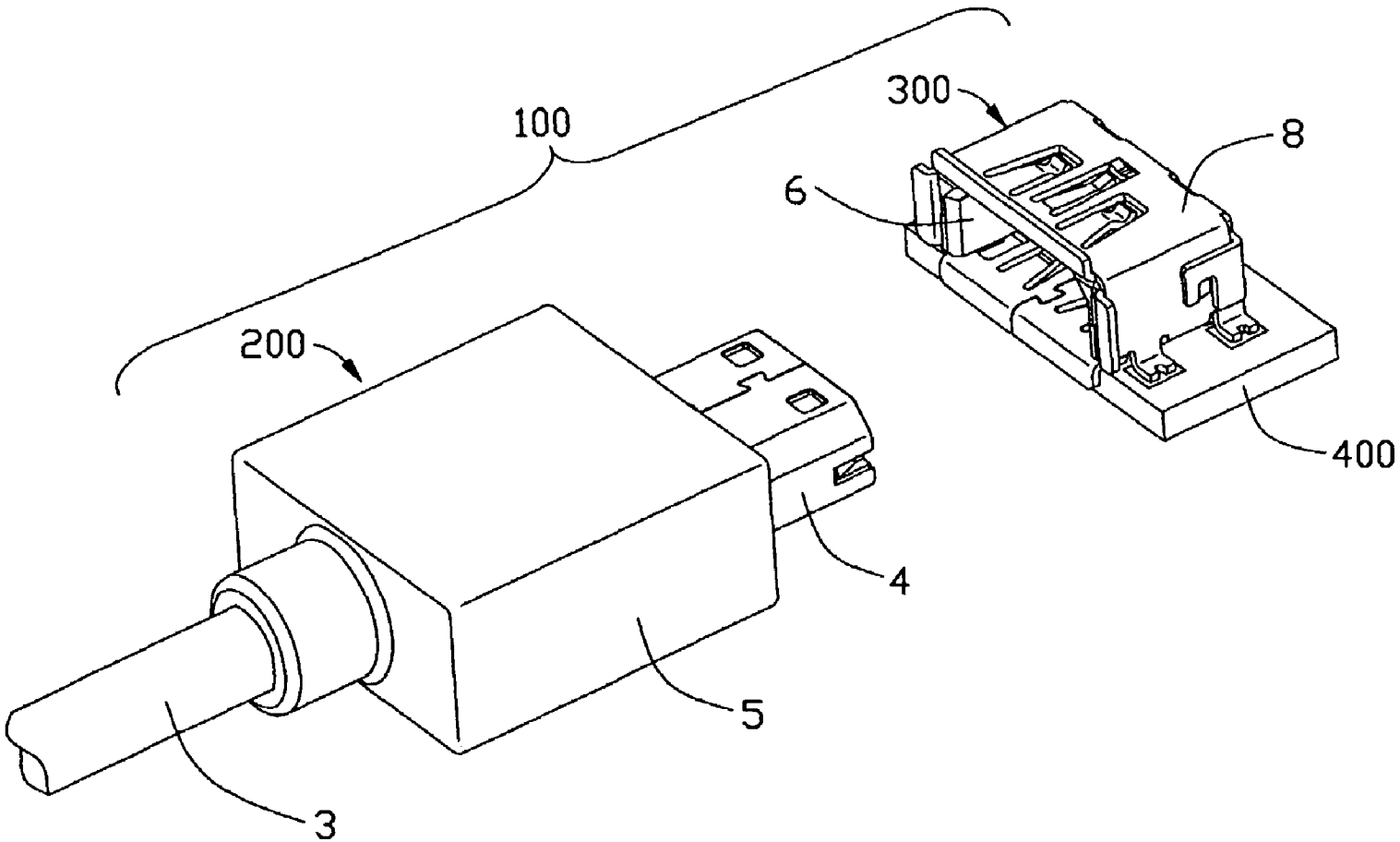
FIG. 3 is a perspective view of a plug connector and a receptacle connector of the connector assembly of FIG. 1.
Figure 4:
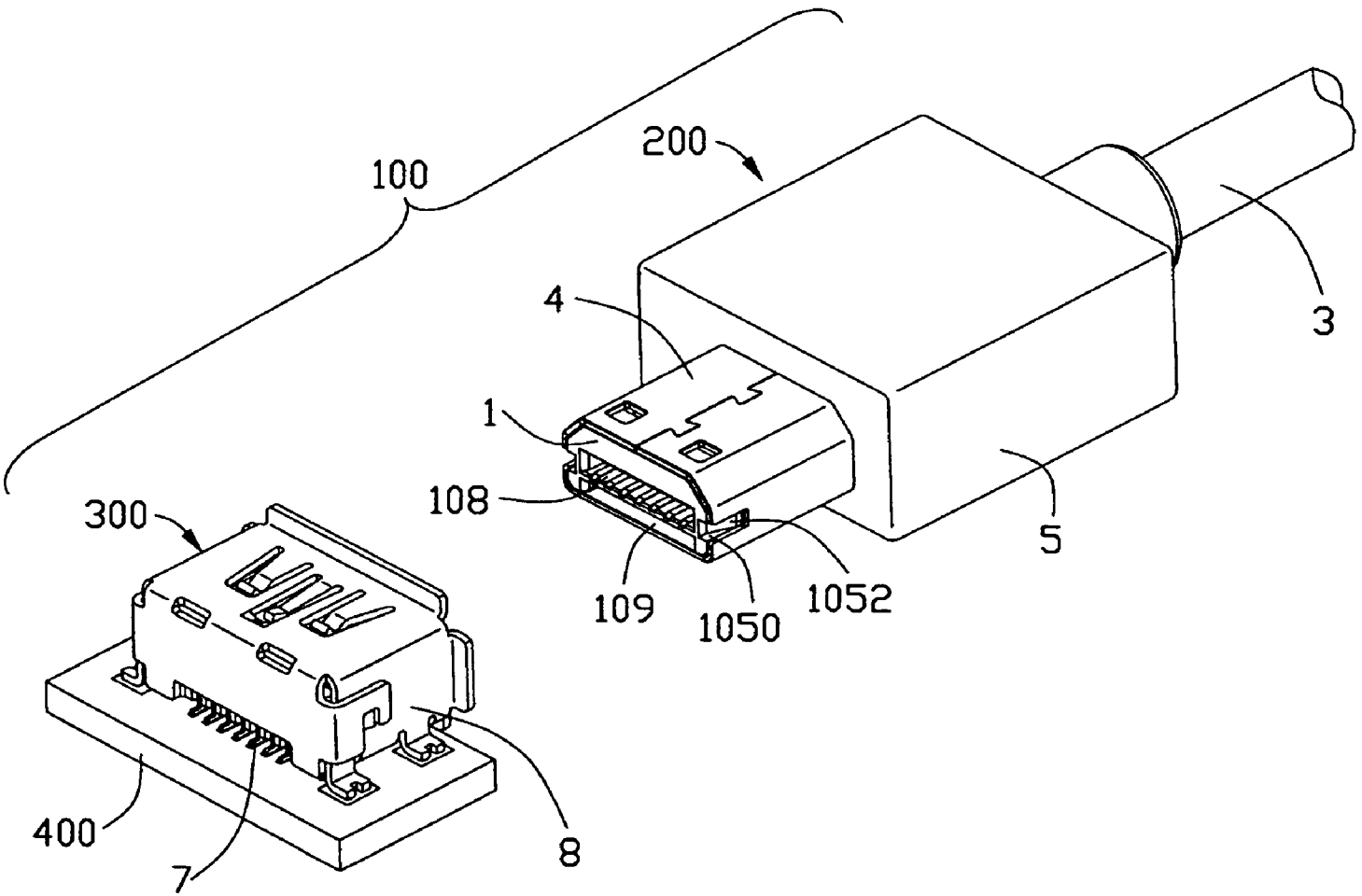
FIG. 4 is a view similar to FIG. 3, but viewed from a different aspect.
Figure 5:
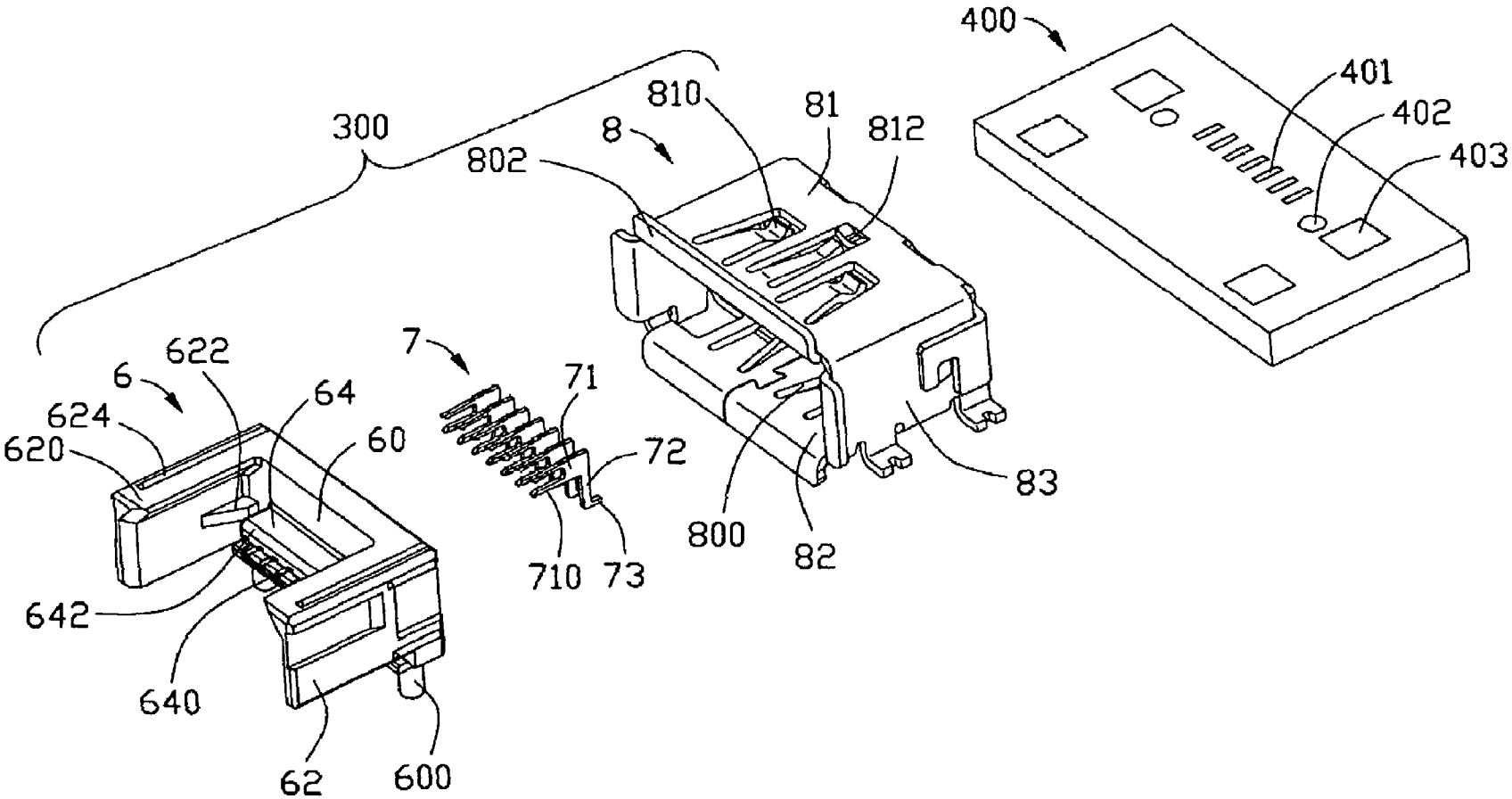
FIG. 5 is an exploded, perspective view of the receptacle connector.
Figure 6:
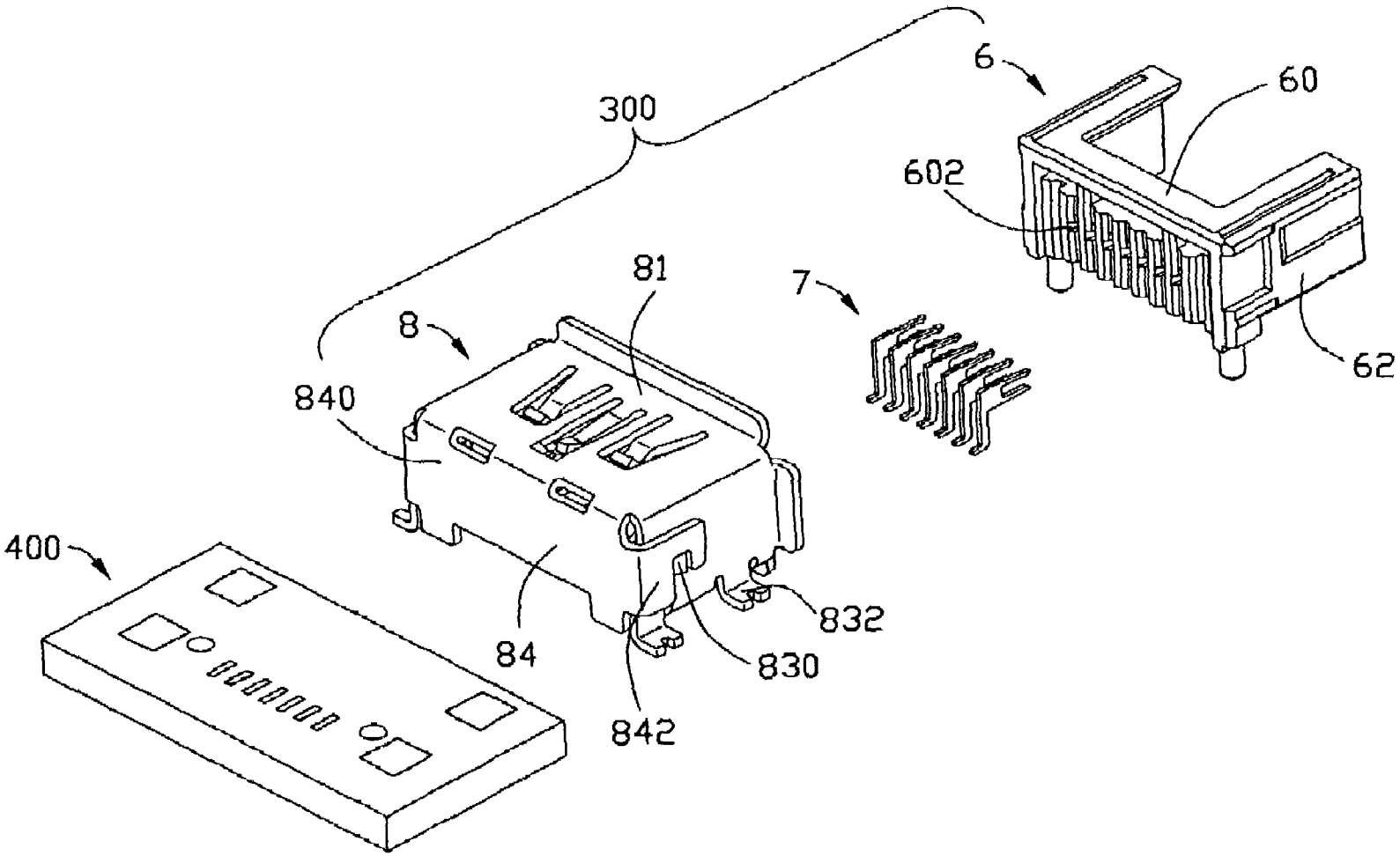
FIG. 6 is a view similar to FIG. 5, but viewed from a different aspect.
Figure 7:
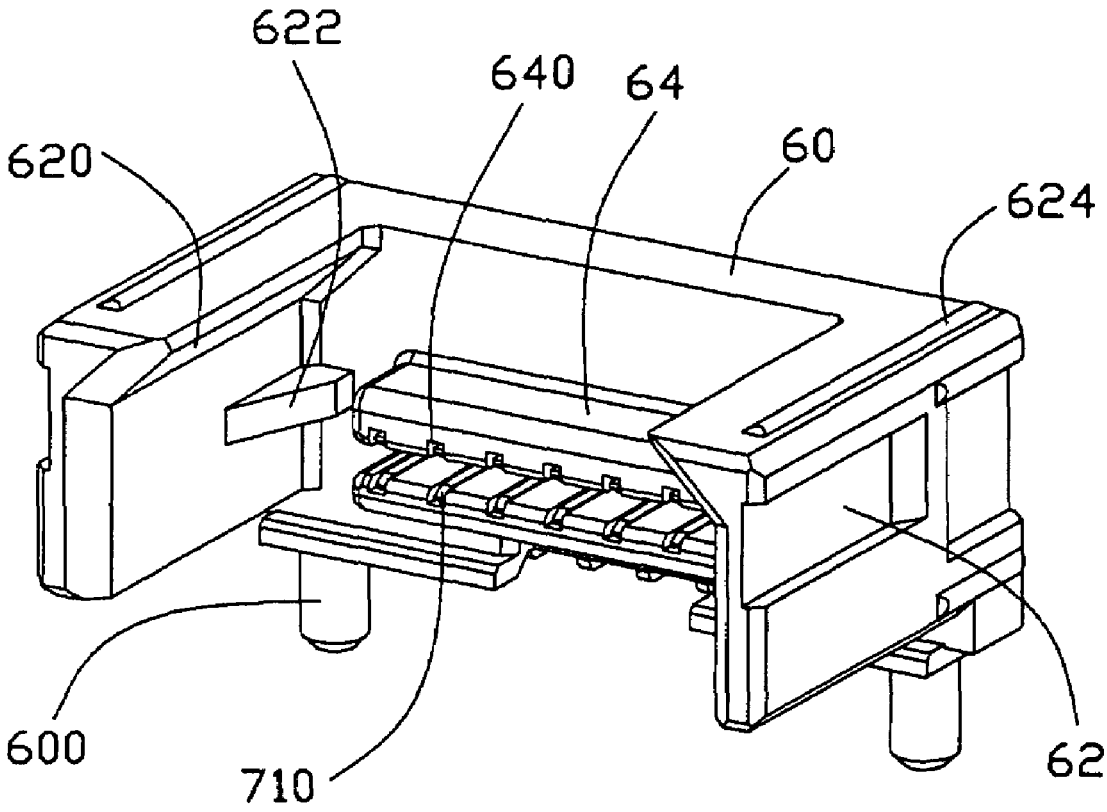
FIG. 7 is a partially assembled view of FIG. 5, illustrating the assembly of a first housing and first contacts.

Please refer to FIGS. 5-7 in conjunction with FIGS. 3-4, the receptacle connector 300 comprises a first housing 6, a plurality of surface-mount type first contacts 7 assembled to the first housing 6, and a first conductive shell 8 enclosing the first housing 6 and the first contacts 7.

The first housing 6 is made of insulative material and comprises a vertical base plate 60, a pair of stretching arms 62 extending from opposite lateral ends of the base plate 60, and a tongue portion 64 extending from the middle of front surface of the base plate 60 along the same direction as that of the stretching arms 62. The base plate 60 defines a plurality of first passageways 602 therethrough. The tongue portion 64 comprises a pair of halves 642 parallel to each other and aligned with each other along vertical direction. Each half 642 defines a plurality of channels 640 on inner surface thereof and aligning with the channels 640 on the other half 642. The passageways 602 respectively communicate with the channels 640 of the tongue portion 64. Each stretching arm 62 A pair of wedges 622 are formed on opposite inner surfaces of the stretching arms 62 and respectively located adjacent to the opposite lateral ends of the tongue portion 64. Each stretching arm 62 forms a wedged upper flange 620 extending toward the other stretching arm 62 and a protruding rib on upper surface thereof for enhancing the connection with the first conductive shell 8. A pair of positioning posts 600 depends downwardly from bottom surface of the base plate 60 and are spaced from each other.

Each first contact 7 is mainly located in a vertical surface and comprises a flat body section 71, a dual-beam mating section 710 extending forwardly from the body section 71, a vertical connecting section 72 depending downwardly from the body section 71, and a horizontal soldering section 73 extending rearwardly from the connecting section 73 for surface mounted to the circuit board 400.

The first conductive shell 8 is a rectangular frame and comprises a top wall 81, an opposite bottom wall 82, a pair of sidewalls 83 connecting with the top wall 81 and the bottom wall 82, and a rear wall 84 connecting with the rear edge of the top wall 81 and cooperating with the pair of sidewalls 83. A receiving space 800 is circumscribed by the walls 81, 82, 83 and 84. The rear wall 84 is U-shape and comprises a flat section 840 bending downwardly from the top edge of the top wall 81 and a pair of subsections 842 extending forwardly from opposite lateral edges of the flat section 840. Each subsection 842 is substantially L-shape and forms a rectangular hole 844. Each sidewall 83 forms a pair of solder pads 832 spaced arranged on the lower edge thereof along front-to-back direction and a tab 830 latching in the rectangular hole 844 of the rear wall 84 to form reliable connection with the rear wall 84. Each of the top wall 81 and rear wall 82 forms a pair of first spring fingers 810 and a second spring finger 812 located between the pair of first spring fingers 810 with free end thereof located nearer to the rear edge of the top wall 81 than those of the first spring fingers 810. A plurality of guiding tabs 802 are respectively stamped with the walls 81, 82 and 83 and bending outwardly from the walls for guiding the insertion of the plug connector 200.

The circuit board 400 forms a plurality of slim golden fingers 401 aligned on top surface thereof, a pair of circular holes 402 located at opposite sides of the lined golden fingers 401, and two pairs of wider golden fingers 403.

In assembly, the first contacts 7 respectively protrude through the first passageways 602 of the first housing 6 with the dual-beam contacting sections 710 received in the channels 640 of the halves 642 of the tongue portion 64, and the soldering sections 73 exposed out of the first housing 6 to be soldered to the golden fingers 401 of the circuit board 400. The first conductive shell 8 is assembled to the first housing 6 with the first housing 6 received in the receiving space 800 thereof. Then the receptacle connector 300 is mounted to the circuit board 400 with the positioning posts 600 protruding through the pair of circular holes 402, and the soldering sections 73 of the first contacts 7 and two pairs of solder pads 832 respectively soldered on the slim golden fingers 401 and the wider golden fingers 403.

Figure 8:
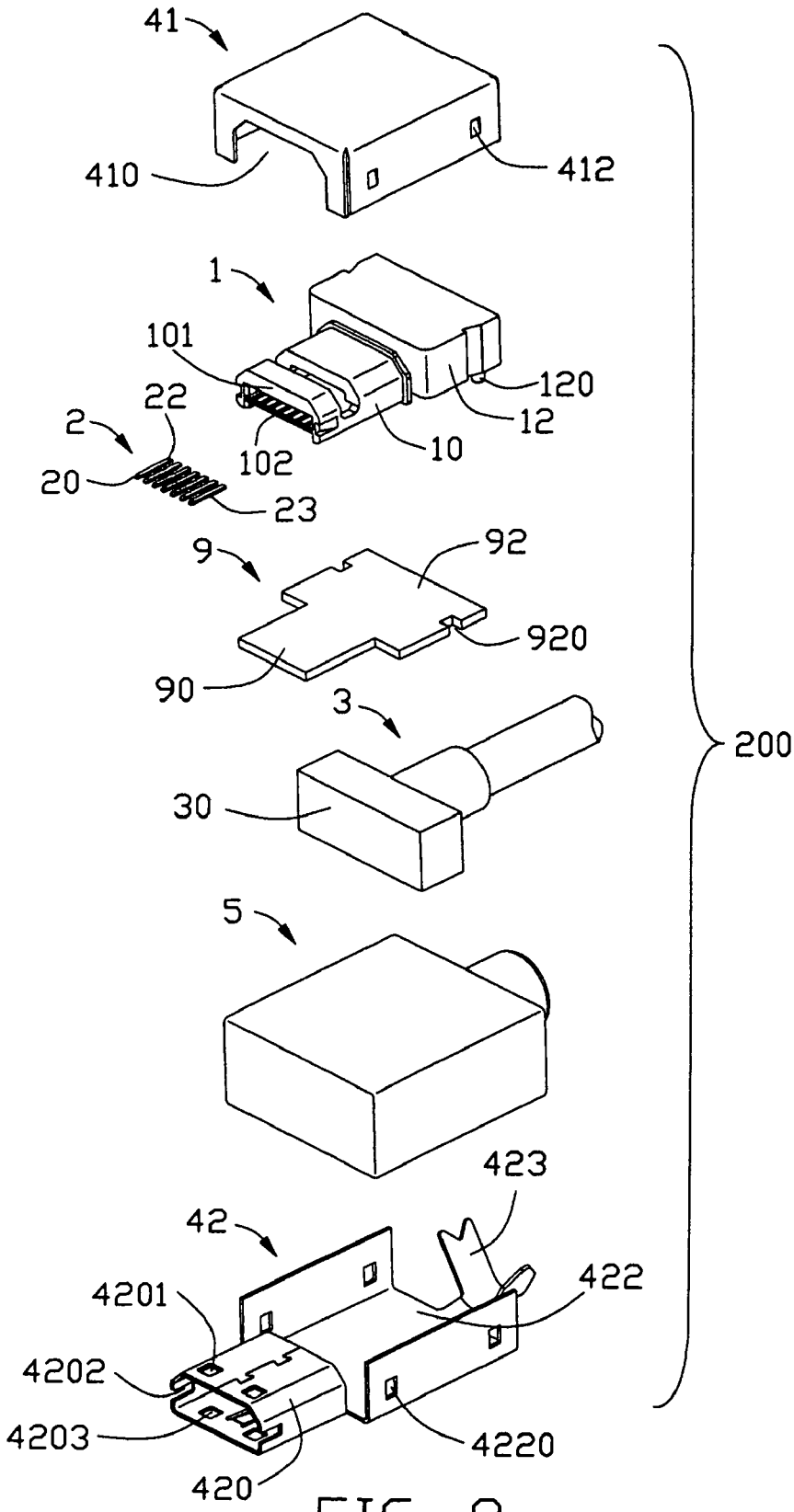
FIG. 8 is an exploded, perspective view of the plug connector.
Figure 9:
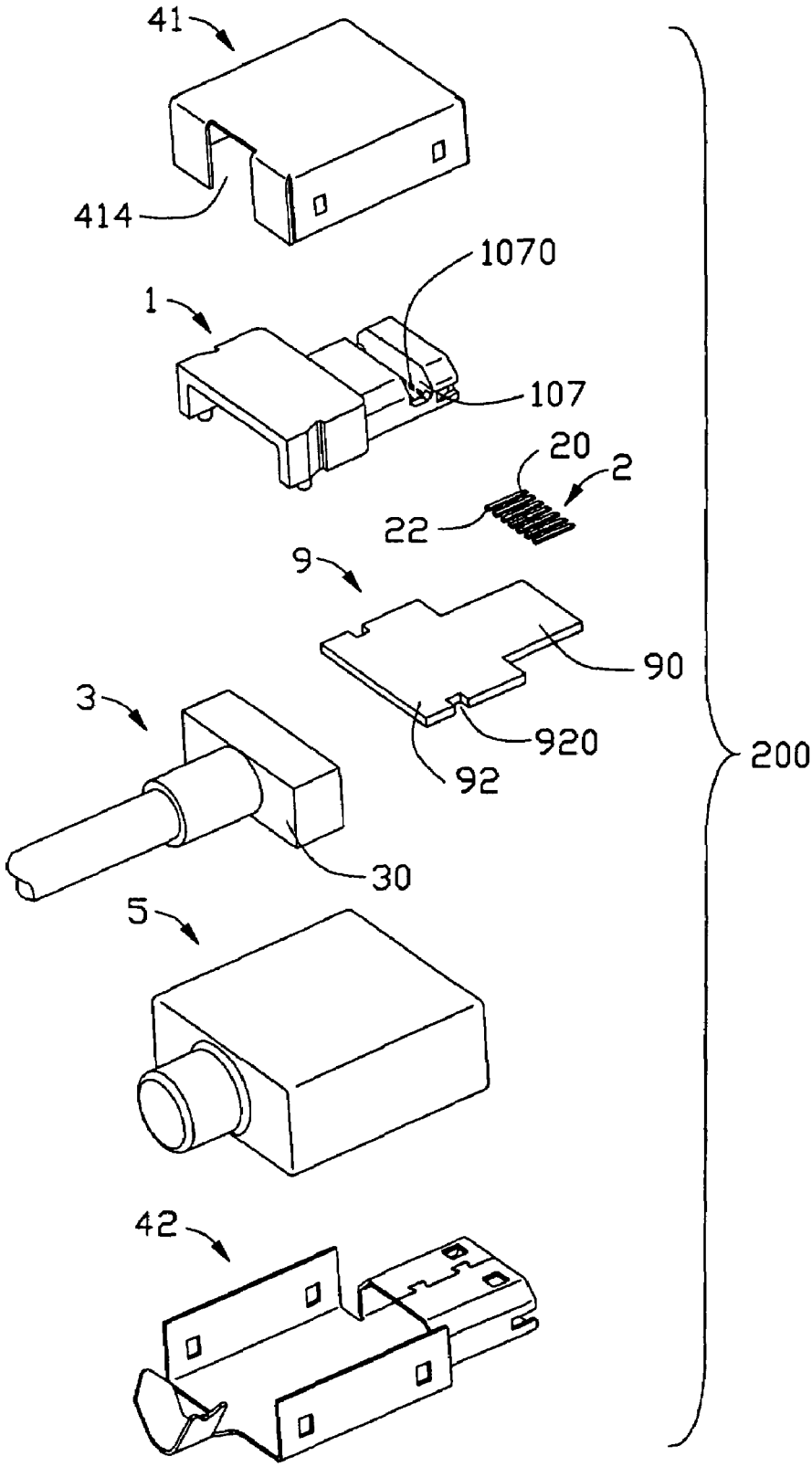
FIG. 9 is a view similar to FIG. 8, but viewed from a different aspect.
Figure 10:
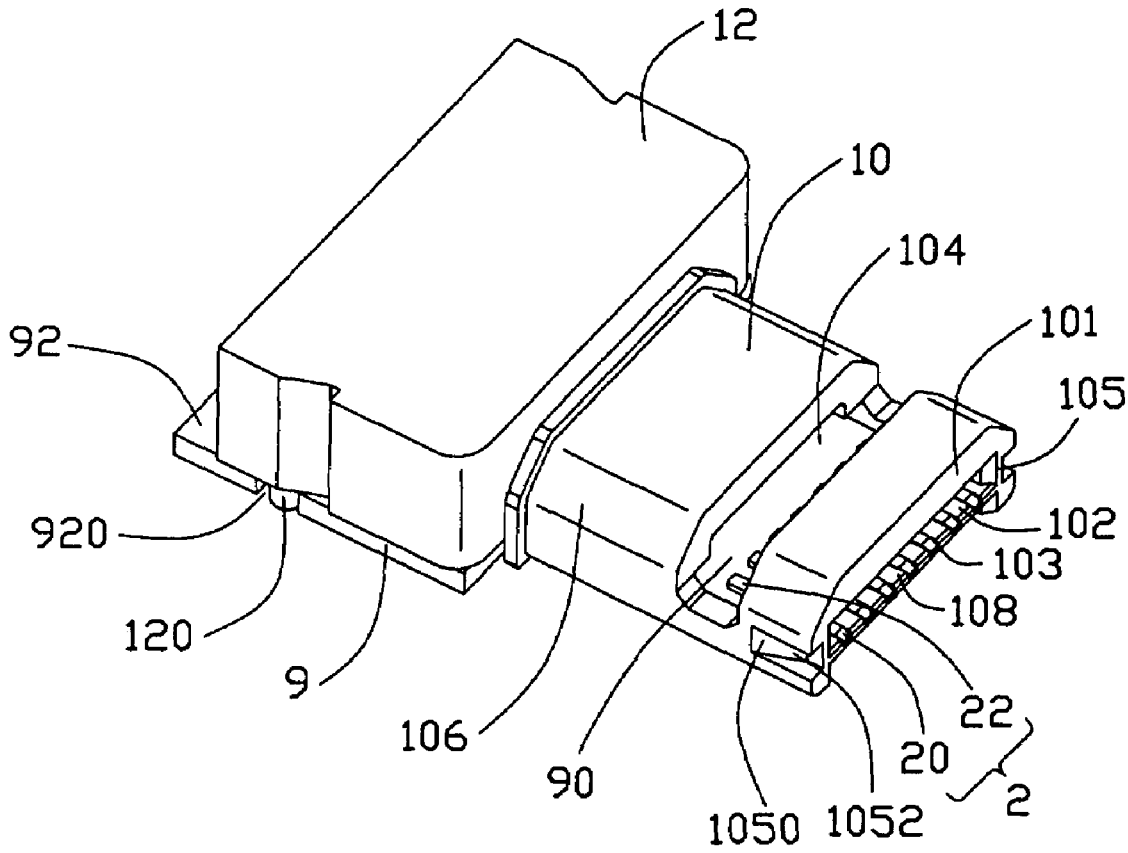
FIG. 10 is a partially assembled view of FIG. 8.
Figure 11:
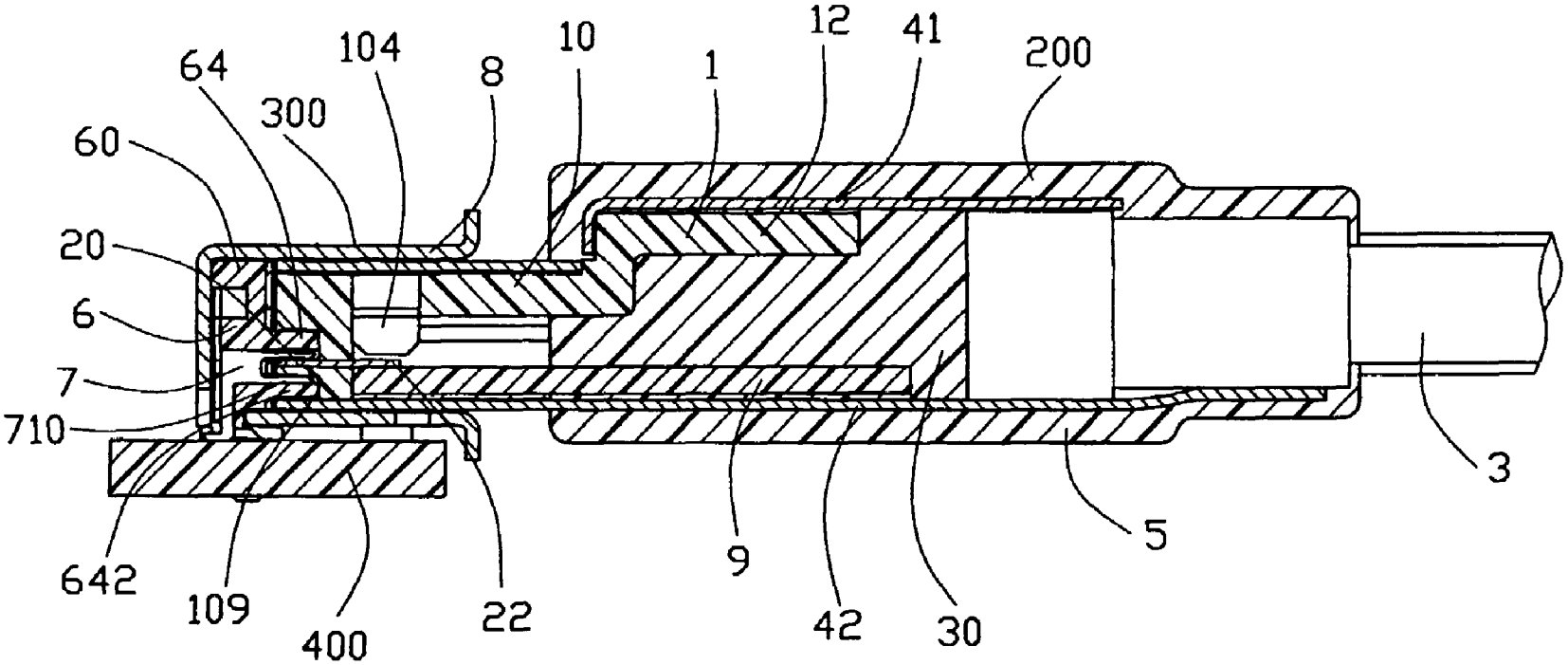
FIG. 11 is a cross-section view taken along line 11-11 of FIG. 1.

Referring to FIGS. 8-10, the plug connector 200 comprises a second housing 1, a plurality of second contacts 2 received in the second housing 1, an inner circuit card 9 electrically connecting with the second contacts 2, a cable 3 electrically connecting with the circuit card 9, an inner mold 30 enclosing the junctions between the cable 3 and the circuit card 9, a second conductive shell 4 enclosing the second housing 1, and an outer mold 5 partially enclosing the second conductive shell 4.

The second housing 1 comprises a base portion 12 and a mating portion 10 extending rearwardly from the base portion 12. The base portion 12 is substantially n-shape and comprises a top wall and a pair of sidewalls. Each sidewall forms a column 120 depending downwardly from bottom surface thereof. The mating portion 10 comprises a pair of sidewalls 105, a thick upper wall 101 connecting with upper ends of the sidewalls 105, a thinner inner insert section 102 opposite to the upper wall 101 and connecting with middle of the sidewalls 105. The opposite ends of the upper wall 101 is partially cutoff to form a pair of inclined edges 106 connecting with the pair of sidewalls 105. The mating portion 10 defines a window 104 to divide the mating portion 10 into a front portion and a rear portion. The insert section 102 connects with middle of the pair of sidewalls 105 and thus, a first space 108 and a second space 109 are respectively formed and spaced by the insert section 102. The front portion of the mating portion 10 comprises a rear wall 107 defining a plurality of second passageways 1070 therethrough to communicate with the window 104. The insert section 102 of the front portion defines a plurality of second channels 103 therein. The first space 108 communicates with the second passageways 1070 and the second channels 103. The rear portion of the mating portion 10 also defines a receiving space circumscribed by the walls 101 and 105 to communicate with the second passageways 1070 and the base portion 12 and opened toward bottom. Each sidewall 105 defines a recess 1050 communicating with the front face of the mating portion 10 and formed with an inclined wedge 1052 in a rear portion thereof.

The second contacts 2 are arranged in a row and received in the front portion of the mating portion 10 of the second housing 1 with flat mating sections 20 thereof received in the second channels 103 and partially exposed in the receiving space 108, and middle interference sections 23 interferentially received in the second passageways 1070 and tail portions 22 exposed out of the front portion and capable of being viewed from the window 104. The second contacts 2 comprises a plurality of signal contacts and a plurality of ground contacts alternatively arranged with the signal contacts to realize MIMO transmission. In addition, the second contacts 2 are stamped from metal material and are thus, low cost.

The inner circuit card 9 forms a plurality of circuit traces (not shown) arranged on opposite front and rear edges thereof and comprises a narrower front section 90 and a wider rear section 92. The narrower front section 90 is received in the mating portion 10 of the second housing 1 with circuit traces thereon soldered with the tail sections 22 of the second contacts 2 from the window 104. The wider rear section 92 defines a pair of cutouts 920 on lateral edges thereof and the base portion 12 of the second housing 1 is located on the rear section 92 with the columns 120 of the base portion 12 received in the cutouts 920 for positioning the inner circuit card 9 to the second housing 1. The rear edge formed with the circuit traces is exposed out of the base portion 12.

The cable 3 comprises three single ended coaxial wires (not shown) and each comprising a signal conductor (not shown), and a metal braiding layer enclosing the signal conductors. The signal conductors and the braiding layers are respectively soldered with the circuit traces of the wider rear section 92 of the inner circuit card 9 in the base portion 12 of the second housing 1 to form a plurality of junctions. The inner mold 30 is then molded with the junctions between the cable 3 and the inner circuit card 9 and located adjacent to the base portion 12.

The second conductive shell 4 comprises an upper half 41 and a lower half 42 engagable with the upper half 41 to enclose the second housing 1 therein. The lower half 42 comprises a front mating port 420, a U-shape half-frame 422 formed with the lower wall of the mating port 420 and a strain relief section 423 formed with the half-frame 422. The mating port 420 has the shape same as that of the mating portion 10 of the first housing 1 and defines two pairs of rectangular holes 4201, 4203 respectively in upper and lower walls (not labeled) and a pair of cutouts 4202 respectively in sidewalls (not labeled) corresponding to the recesses 1050 of the first housing 1 and communicating with the front edge of the mating port 420. The half-frame 422 is U-shape and forms two pairs of latching holes 4220 on opposite sidewalls (not labeled). The upper half 41 is the other half-frame cooperating with the half-frame 422 of the lower half 42 and further comprises a front wall (not labeled) and a rear wall (not labeled) respectively defining a relatively large opening 410 and a relatively small opening 414 corresponding to the outer periphery of the mating port 10 and the cable 3. The sidewalls (not labeled) define two pairs of tabs 412 latching into the latching holes 4220 of the lower half 41. The mating port 420 receives the mating portion 10 of the second housing 1 with the recesses 1050 aligned with the cutouts 4202 and the second space 109 (FIG. 4) is formed among the insert section 102, the sidewalls 105 of the second housing 1 and the lower wall of the second conductive shell 8. The half-frame 422 and the upper half 41 together form a space to corporately receive the base portion 12 of the second housing 1, the inner circuit card 9 and the inner mold 30 with the strain relief section 423 grasped the cable 3 and electrically connecting with metal braiding layer (not shown) of the cable 3.

Finally, the outer mold 5 is molded with the second conductive shell 4 with the mating port 420 exposed outside.

When mating, with the guidance of the guiding tabs 802 of the first conductive shell 8, the plug connector 200 is inserted into the receptacle connector 300. With the wedges 622 of the stretching arms 62 insert into the recesses 1050 of the second housing 1 and the cutouts 4202 of the second conductive shell 4 to engage with the inclined wedges 1052 of the second housing 1, the second contacts 2 and the lower wall 102 of the second housing 1 is inserted between the pair of halves 642 of the tongue portion 64 with the second mating sections 20 sandwiched by the dual-beam first mating sections 710 of the first contacts 7 to form electrical connection between the first and second contacts 7, 2. The upper wall of the second conductive shell 4 and the upper wall 101 of the second housing 1 occupy the space formed between the tongue portion 64 and the top wall 81 of the first conductive shell 8, and the lower wall of the second conductive shell 4 occupies the space formed between the tongue portion 64 and the bottom wall 82 of the first conductive shell 8. While, the lower half 642 of the tongue portion 64 occupies the space 109 of the plug connector 200. The first spring tabs 810 and the second spring tabs 812 of the first conductive shell 8 are respectively received into the rectangular holes 4201, 4203 of the second conductive shell 4 and press on the upper wall of the second conductive shell 4. After assembly, the pair of wedged upper flanges 620 press on the corresponding portion of the second conductive shell 4 attaching to the inclined edges 106 of the second housing 1. The sidewalls of the second conductive shell 4 are located between the pair of stretching arms 62 of the first housing 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly, comprising:

a receptacle connector, comprising:

a first housing comprising a base plate and a tongue portion comprising a pair of first and second halves; and a plurality of first contacts protruding through the base plate and received in the first and second halves of the first housing; and a plug connector, comprising:

a second housing comprising a pair of sidewalls, an upper wall connecting with upper ends of the sidewalk, and an insert section connecting with the sidewalls to form a first space together with the upper wall and the sidewalls, and a second space together with the sidewalls, the insert section defining a plurality of channels therein;

a plurality of second contacts received in the channels of the insert section of the second housing and partially exposed into the first space;

a conductive shell enclosing the second housing to seal the second space and facing to the insert section;

a cable comprising a plurality of wires respectively electrically connecting with the second contacts; and wherein the first half of the tongue portion of the first housing of the receptacle connector is received in the first space of the second housing, and the second half of the tongue portion is received in the second space of the second housing, and the insert section of the second housing of the plug connector is received between the first and second halves of the tongue portion and the first and second contacts electrically connect with one another.

2. The connector assembly as claimed in claim 1, wherein the second contacts comprise a plurality of signal contacts and a plurality of ground contacts, and wherein the signal contacts and the ground contacts are arranged alternatively.

3. The connector assembly as claimed in claim 1, further comprising a first conductive shell enclosing the first housing and the first contacts and electrically connecting with the second conductive shell.

4. The connector assembly as claimed in claim 1, wherein the connector assembly is RF type connector.

5. The connector assembly as claimed in claim 1, wherein the first and second contacts receive/transmit more than one signal at one time.

6. The connector assembly as claimed in claim 1, wherein each first contact comprises a body section received in the base plate, a dual-beam mating section received in the tongue portion to electrically connect with the second contact, and a soldering section adapted for connecting to a circuit board.

7. The connector assembly as claimed in claim 1, wherein the second half of the first housing of the receptacle connector is received in the second space to be sandwiched between the insertion section of the second housing and the conductive shell.

8. The connector assembly as claimed in claim 1, wherein the plug connector further comprises an inner circuit card electrically connecting with the second contacts and the cable.

9. The connector assembly as claimed in claim 8, wherein the upper wall of the second housing defines a window, and wherein the circuit card and the second contacts are soldered together from the window.

10. The connector assembly as claimed in claim 1, wherein the upper wall of the second housing is partially cut to form a pair of inclined edges respectively connecting with the sidewalls.

11. The connector assembly as claimed in claim 10, wherein the first housing comprises a pair of stretching arms extending from the base plate, and wherein the tongue portion is located between the stretching arms.

12. The connector assembly as claimed in claim 11, wherein each stretching arm forms a wedged upper flange extending toward the other stretching arm, and wherein the stretching arm presses on the inclined edge of the second housing.

13. The connector assembly as claimed in claim 11, wherein each stretching arm forms a wedge adjacent to the tongue portion, and wherein the second housing defines a recess on each sidewall thereof to guide the wedge of the first housing thereinto.

14. An electrical connector assembly comprising:

mated first and second connectors, said first connector including:

a first insulative housing enclosed in a first metallic shell;

a receiving space defined in a front portion of the first shell;

a tongue portion extending forwardly of the first housing and into the receiving space, said tongue portion extending along a longitudinal direction perpendicular to a front-to-back direction of the first housing and divided into first and second halves along said longitudinal direction;

a plurality of first contacts disposed in a middle cavity of the tongue portion and between said first and second halves;

said second connector including:

a second insulative housing enclosed in a second metallic shell;

a tongue plate extending forwardly of the second housing;

a plurality of second contacts disposed in the second housing and on at least one side of said tongue plate; wherein the tongue plate is inserted into the middle cavity to have the corresponding first and second contacts engaged with each other, respectively; wherein the first half engages the second housing while the second half engages the second shell in a vertical direction perpendicular to both the longitudinal direction and the front-to-back direction.

15. The electrical connector assembly as claimed in claim 14, wherein said second contacts essentially confront the first half while segregated from the second half by the tongue plate in said vertical direction.

* * * * *